United States Patent [19]

King

[11] 4,161,938

[45] Jul. 24, 1979

[54] INTERNAL COMBUSTION ENGINE WITH IMPROVED INTAKE VALVE CONTROL SYSTEM

[76] Inventor: Charles L. King, 703 Rozanne Dr., Addison, Ill. 60101

[21] Appl. No.: 907,002

[22] Filed: May 18, 1978

[51] Int. Cl.[2] ..... F02D 13/06

[52] U.S. Cl. ..... 123/198 F; 123/105

[58] Field of Search ..... 123/198 F, 105, 112, 123/103 R

[56] References Cited

U.S. PATENT DOCUMENTS

| | | | |
|---|---|---|---|
| 1,275,752 | 8/1918 | Roberts | 123/198 F |
| 1,331,787 | 2/1920 | Schlatter | 123/198 F |
| 2,528,983 | 11/1950 | Weiss | 123/198 F |
| 3,874,358 | 4/1975 | Crower | 123/198 F |
| 4,096,845 | 6/1978 | Holmes | 123/198 F |

*Primary Examiner*—Ira S. Lazarus

*Attorney, Agent, or Firm*—Leydig, Voit, Osann, Mayer & Holt, Ltd.

[57] ABSTRACT

A four cycle internal combustion engine having an intake valve conrtrol system adapted to automatically cause the engine to run on less than all of its cylinders during low speed conditions, while under high speed conditions allowing the previously unused cylinders to progressively come into play as greater power requirements are needed. In the illustrated engine, the intake valves for every other cylinder in the firing sequence are controlled solely by biasing springs which have sufficient strength to maintain the valve in a substantially closed condition during low speed operation, but which yield to pressures developed during high speed operation to permit full use of the cylinders as needed. The intake valves for the remaining other cylinders are cam controlled to ensure smooth idling and operation of the engine under low speed and power conditions.

6 Claims, 3 Drawing Figures

INTERNAL COMBUSTION ENGINE WITH IMPROVED INTAKE VALVE CONTROL SYSTEM

DESCRIPTION OF THE INVENTION

The present invention relates generally to internal combustion engines and more particularly to four-cycle, piston-type, internal combustion engines.

In view of the dwindling resources of crude oil and the increasing cost of fuel for automobiles, there has been the continuing effort to develop more efficient internal combustion engines for automobiles. Various approaches heretofore have been proposed for controlling the introduction of fuel into engine cylinders to achieve most efficient utilization. Many of these approaches have resulted in smaller sized engines, both in number of cylinders and cubic inches of displacement. Such reduced sized engines have the inherent disadvantage of lacking the power often desired or needed for highway driving, and such engines particularly result in sluggish performance when used in relatively large and heavy automobiles. When efforts have been made to reduce the amount of fuel introduced into the cylinders during low speed or low power conditions, in lieu of reducing the cylinder size, the engines have been characterized by poor idling and the inability to develop power when needed. Still other approaches have been directed to electronic fuel control means which are not only expensive, but also have yet to be proven as effective means for improving fuel economy of large engines.

It is an object of the present invention to provide a valve control system for internal combustion engines which achieves improved fuel economy.

Another object is to provide a valve control system as characterized above which enables relatively large engines to operate with improved fuel economy during low speed and low power conditions, but which permits the engine to utilize its full power when needed.

A further object is to provide an intake valve control system for internal combustion engines which during low speed and low power conditions automatically causes the engine to run on fewer than all of its cylinders, while under higher speed conditions allows other cylinders to progressively come into play as greater power requirements are needed.

Yet another object is to provide an intake valve control system of the foregoing type which under low power conditions permits the cylinders in use to be operated at relatively high efficiency levels.

Another object is to provide such a valve control system which insures good idling of relatively large engines when being operated under minimum fuel and power conditions.

Still another object is to provide such a valve control system which is relatively simple in construction and permits easy conversion of existing engines.

Other objects and advantages of the invention will become apparent from the following detailed description and upon reference to the drawings, in which.

Figure 1:
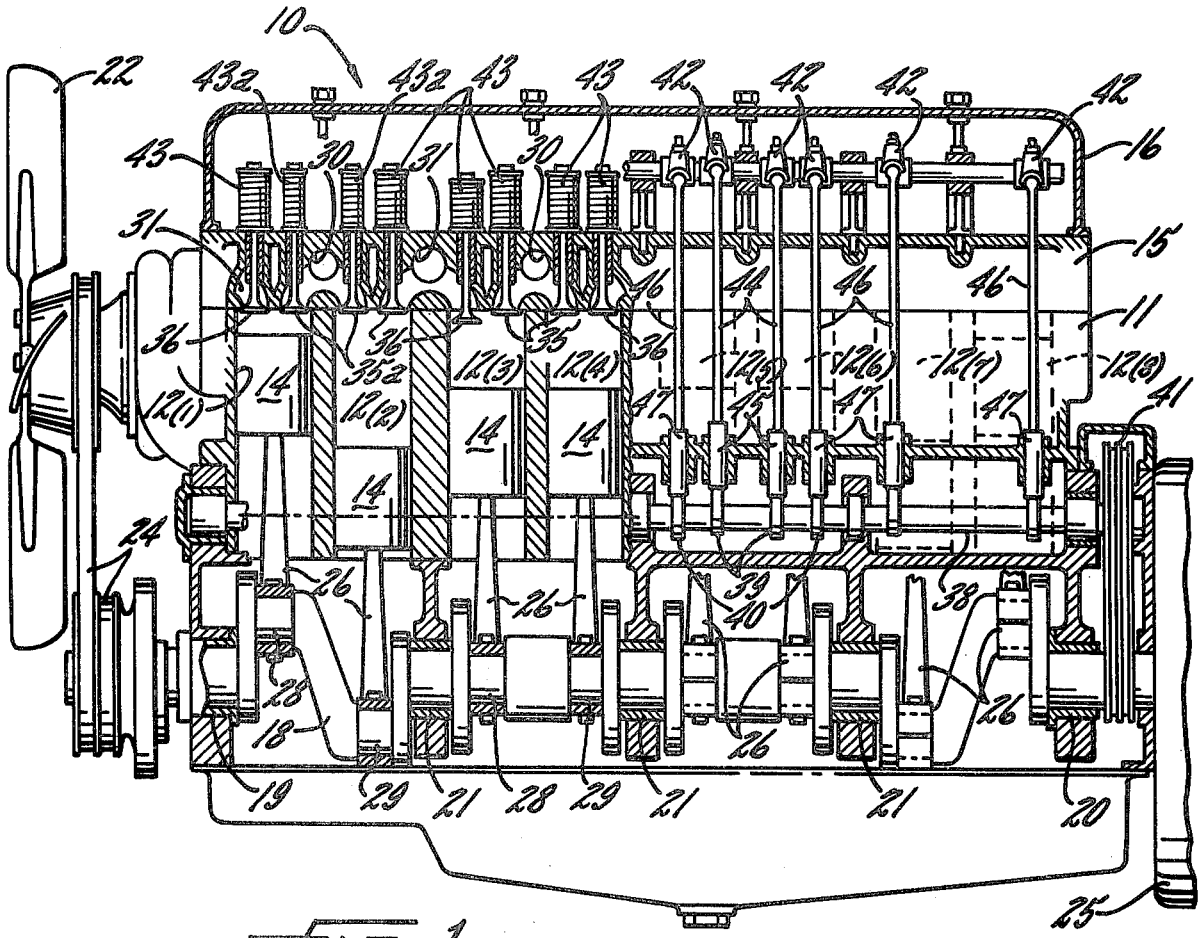
FIG. 1 is a vertical section of an illustrative internal combustion engine having an intake valve control system embodying the present invention.

While the invention is susceptible of various modifications and alternative constructions, a certain illustrative embodiment has been shown in the drawings and will be described below in detail. It should be understood, however, that there is no intention to limit the invention to the specific form disclosed, but, on the contrary, the intention is to cover all modifications, alternative constructions, and equivalents falling within the spirit and scope of the invention.

Referring more particularly to FIG. 1 of the drawings, the invention is there embodied in an illustrative four cycle, internal combustion engine 10. The illustrated engine 10 is an in-line type having a cylinder block 11 formed with a plurality of cylinders 12(1)–12(8), in this case eight in number, with the reference numeral for each cylinder 12 in this discussion also including a numeral designation of the cylinder's location relative to the front of the engine. The cylinders 12 in this instance are arranged in a line and each contains a piston 14 for reciprocating movement. Mounted upon the cylinder block 11 is a cylinder head 15 which in turn supports a cover 16 enclosing the upper end of the cylinder head 15. The illustrated cylinder head 15 is of the flat type having a substantially coplanar underside surface which defines the upper end of the cylinders 12.

A crankshaft 18 is supported within the cylinder block 11 below the cylinders 12 by front and rear bearings 19, 20, and intermediate bearings 21. A forward end of the crankshaft 18 is adapted to drive a fan 22 and other common accessories through drive belts 24, and the rearward end of the crankshaft 18 may drive a typical transmission contained within a housing 25.

To drive the crankshaft 18, each piston 14 is connected to the crankshaft 18 by a connecting rod 26 in the usual manner. The crankshaft 18 in this case is formed with pairs of eccentrically disposed crank pin bearings 28, 29 between each crankshaft bearing support. Each crank pin bearing 28 receives a connecting rod 26 of one of the pistons 14 and the other crank pin bearing 29 receives a connecting rod for the piston in the immediately adjacent cylinder.

Each of the cylinders 12 has an associated inlet port 30 and an exhaust outlet port 31 which are formed in the cylinder head 15. In this case, a suitable carburator, not shown, is adapted to receive separate streams of gasoline and air and initially mix the air and fuel in predetermined portions in a conventional manner. This air-fuel mixture then flows into an intake manifold of a known type which serves to direct the mixture to the inlet ports 30 for the respective cylinders 12. The exhaust ports 31 similarly may communicate with an exhaust manifold from which the exhaust gases eventually emit into the atmosphere.

Figure 2:
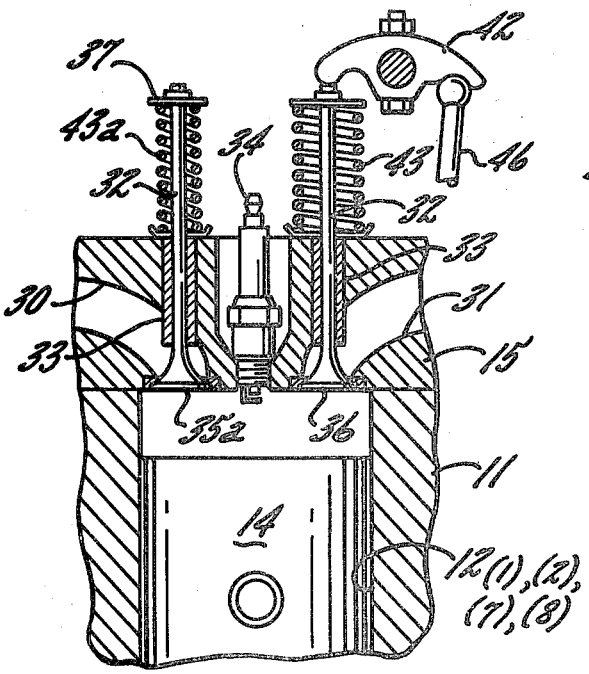
FIG. 2 is an enlarged fragmentary section of one of the cylinders of the engine shown in FIG. 1 showing its intake and exhaust valve control.
Figure 3:
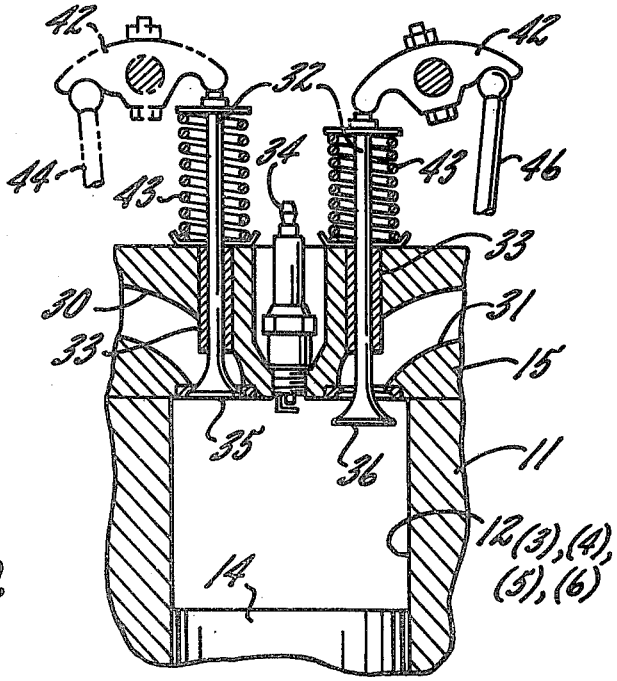
FIG. 3 is an enlarged fragmentary section of another of the cylinders of the illustrated engine showing its intake and exhaust valve control.

In order to control the flow of gases into and out of each cylinder 12 through the ports 30, 31, intake valves **35, 35*a* and exhaust valves 36, respectively, are reciprocally mounted within the cylinder head 15. Conventional electrical ignition means including a spark plug 34 at the top of each cylinder (shown in FIGS. 2 and 3) may be provided for igniting the fuel that is introduced into the cylinders 12. While the firing order of the cylinders generally is selected for design of each engine, the illustrated engine typically employs an ignition timing such that cylinders number 1,6,2,5,8,3,7 and 4** are sequentially fired.

In accordance with the present invention, a valve control system is provided that automatically causes the engine to run on less than all of its cylinders during low speed and low power conditions, while under high speed conditions allowing previously unused cylinders to progressively come into play for greater speed and power requirements. To this end, the intake valves for some, but not all, of the cylinders are controlled wholly by spring means which have sufficient strength to maintain the valve in a substantially closed condition during low speed operation, but which yield to pressures developed during higher speed operation to permit full use of such cylinders as power requirements are needed. The intake valves for the remaining other cylinders are controlled by cam actuated means to ensure smooth idling and operation of the engine under low speed and low power conditions. Preferably, the intake valve for every other cylinder in the firing order is spring controlled and the intake valves for the remaining cylinders are controlled by cam means to provide adequate valve opening and fuel supply to half of the cylinders during all operating conditions.

In the illustrated engine, actuation of the exhaust valves 36 for all of the cylinders and the intake valves 35 for cylinders 12(6), 12(5), 12(3) and 12(4), which are every other cylinder in the firing order, is controlled by a cam shaft 38. The cam shaft 38 is formed with a cam lobe 40 for each exhaust valve 36 and a cam lobe 39 for each intake valve 35. As is customary in four cycle internal combustion engines, the cam shaft 38 is driven from the crankshaft 18 from timing chains 41 and is timed to make one revolution for every two revolutions of the crankshaft 18. The valves 35, 36 in this case each are attached at their upper end to a respective rocker arm 42 which has one end biased by a spring 43 in an upward valve closing position. A push rod 44 and lifter 45 transfer motion from each cam lobe 39 to the rocker 42 for the respective intake valve 35 and a similar push rod 46 and lifter 47 transfer motion from each cam lobe 40 to each exhaust valve rocker. The springs 43 are designed to have sufficient strength to maintain the respective valves 35, 36 in a closed condition at all times during operation of the engine except when the spring force is overcome by the cam actuation which moves the rocker 42 to a valve opening position. As is known in the art, the cam lobes 39 open each intake valve 35 during the intake stroke of the respective cylinder, while the cam lobes 40 serve to actuate opening of the exhaust valves 36 during the exhaust stroke of the operating cycle.

In keeping with the invention, the intake valves **35*a* for cylinders 12(1), 12(2), 12(8) and 12(7) each are controlled wholly by springs 43*a* which are designed to eliminate or minimize intake valve opening, and thus the introduction of fuel to the cylinder, during low speed and power conditions while allowing the valves to open to progressively greater amounts during high speed operation of the engine. In the illustrated embodiment, each intake valve 35*a* is identical to the intake valves 35, and includes a stem 32 extending upwardly through the cylinder head 15. The stem 32 is slidably disposed in a guide sleeve 33 to ensure proper movement of the valve. The springs 43*a* each are positioned over the valve stem 32 and are interposed between the top of the cylinder head 15 and a flange 37 secured to the end of the valve stem. While the size and strength of the springs 43*a* will depend upon the engine size, typically in an eight cylinder 350 cu. in. gasoline engine, the springs may be designed to exert a 2 lb. force when the valve is in a closed position and a 20 lb. force when the valve is lifted ½ in. Preferably, such springs should have the effect of maintaining the valve in a closed position at engine speeds of less than about 800 r.p.m.'s. Thus, during low speed and low power conditions, such springs have the effect of maintaining the intake valve in a substantially closed position throughout the normal cycle of operation of the cylinder so as to minimize or eliminate fuel consumption by cylinders having such spring controlled intake valves. During high speed conditions, however, vacuums created within the cylinder during the intake stroke will be sufficient to draw the valves open against the biasing force of the springs 43*a***. Moreover, as the operating speed of the engine increases further the high velocity of the air flow into the cylinder during each intake stroke will cause the intake valves to open to a greater extent and remain open for a longer period, thereby enabling greater quantities of fuel to be introduced into the cylinder under such operating conditions.

Internal combustion engines with the valve control system of the present invention will be found to obtain improved fuel economy, while maintaining many of the advantages of larger engines. During low speed and low power conditions, the valves which are spring controlled automatically remain closed so as to cause the engine to run on less than all of its cylinders, which is adequate under such driving conditions. It is only during periods of higher speed and power demands that the cylinders with the spring controlled intake valves come into operation. This improves fuel economy for several reasons. First, during low speed operations, the cylinders with such spring controlled intake valves are not consuming fuel. Moreover, the cylinders that are burning fuel during such low power conditions, i.e. those with the cam controlled intake valves, are operating at a higher efficiency levels and with reduced pumping and throttling losses.

It will be seen that since some of the cylinders have intake valves which are cam controlled, those cylinders will receive fuel to achieve good idling and operation under minimum fuel and power conditions. As previously indicated, preferably the intake valves for every other cylinder in the firing sequence is cam controlled, while the remaining alternate cylinders in the firing order are spring controlled to optimize their utilization for the particular driving conditions.

It will further be appreciated by one skilled in the art that the valve control system of the present invention is relatively simple in construction and lends itself to ready conversion of existing engines. For example, in a typical conventional engine, all of the intake valves would be cam controlled. For the intake valves that are to be converted to spring control, it would be necessary to simply remove the rockers 42 and springs 43, and replace with a lighter spring **43*a* in the manner described herein, which would have biasing characteristics necessary to control opening and closing of the valves as desired. Appropriate means, such as the flange 37, can be used for securing the spring in the desired prestressed valve closing position. It has been found preferable to also replace the rocker arm 42 with a suitable stationary holder that can be secured to the rocker arm support shaft in position out of engagement with the spring 43*a*** for holding the push rod in a slightly raised position out of operating engagement with its respective lifter while allowing the lower end of the push rod to retain the lifter in its support sleeve. It will be appreciated that such alteration will eliminate the operating effect of the lifter and push rod without disturbing the engine oil pressure.

While the present invention has been illustrated in an eight cylinder in-line engine, it will be understood that the invention is equally applicable to other engine configurations and sizes.

I claim as my invention:

1. An internal combustion engine for automobiles and the like comprising:

a cylinder block formed with a plurality of cylinders, a piston mounted within each cylinder for reciprocating movement in a four stroke operating cycle comprising an intake stroke, a compression stroke, a power stroke and an exhaust stroke, a crankshaft rotatably driven by reciprocating movement of said pistons, an intake port communicating with each said cylinder, means for directing fuel into each said cylinder, an intake valve for each intake port mounted for movement between an open position permitting gas flow into the respective cylinder and a closed position blocking gas flow into the cylinder, an exhaust port leading from each said cylinder, an exhaust valve for each exhaust port mounted for reciprocating movement between a position closing the outlet port from the respective cylinder and a position opening the outlet port, cam means for opening and closing the intake valves for some of said cylinders during each cycle of operation in predetermined timed relation to said crankshaft rotation, spring means for controlling the opening and closing of the intake valves of the other cylinders, said spring means including a biasing spring for urging the intake valve of each said other cylinder to a normally closed position while permitting progressively greater opening of the respective intake valve on intake strokes during relatively high speed operation than during lower speed operation of the engine, electrical means for igniting the fuel introduced into said cylinders in timed firing sequence, and means for opening and closing said exhaust valves in timed relation to said crankshaft rotation to permit exhaust of gases from said cylinders through said exhaust ports.

2. The internal combustion engines of claim 1 in which the biasing spring for the intake valves of each said other cylinder is sized such as to hold the respective intake valve in a closed condition during low speed operation of said engine.

3. The internal combustion engine of claim 2 in which said intake valve biasing springs hold the respective intake valve in a closed position at engine crankshaft speeds of under about 800 r.p.m.'s.

4. The internal combustion engine of claim 1 in which the biasing springs for the intake valves of each said other cylinder is sized such as to hold the respective intake valve in a closed condition during low speed operation but permit progressively greater opening of the intake valves as the operating speed of said engine increases.

5. The internal combustion engine of claim 4 in which the opening and closing of the intake valves for one-half of said cylinders are controlled by said spring means, and the intake valves for the remaining cylinders are controlled by said cam means.

6. The internal combustion engine of claim 5 in which the opening and closing of intake valves for every other cylinder in said firing sequence is controlled by said spring means.

* * * * *